US007837839B2

(12) United States Patent
Fleissner et al.

(10) Patent No.: US 7,837,839 B2
(45) Date of Patent: Nov. 23, 2010

(54) CONDUCTIVE COATING OF SURFACES

(75) Inventors: Peter Fleissner, Alzey (DE); Johannes Fleissner, Alzey (DE)

(73) Assignee: BCT Coating Technologies AG, Solingen (DE)

( * ) Notice: Subject to any disclaimer, the term of this patent is extended or adjusted under 35 U.S.C. 154(b) by 768 days.

(21) Appl. No.: 11/808,102

(22) Filed: Jun. 6, 2007

(65) Prior Publication Data

US 2008/0000769 A1 Jan. 3, 2008

Related U.S. Application Data

(60) Provisional application No. 60/814,700, filed on Jun. 19, 2006.

(30) Foreign Application Priority Data

Jun. 8, 2006 (EP) ..... 06115181

(51) Int. Cl.
*C25D 17/06* (2006.01)

(52) U.S. Cl. ..... 204/206; 204/198; 204/202; 204/207; 204/208; 204/224 R; 204/225; 204/228.7; 204/228.8; 204/242; 204/269

(58) Field of Classification Search ..... 204/198, 204/202, 206, 207, 208, 224 R, 225, 227, 204/228.7, 228.8, 242, 267, 269
See application file for complete search history.

(56) References Cited

U.S. PATENT DOCUMENTS

| | | | | |
|---|---|---|---|---|
| 4,102,772 | A * | 7/1978 | Nakamura et al. | 204/206 |
| 4,559,123 | A | 12/1985 | Moore et al. | |
| 4,820,390 | A * | 4/1989 | Schuster | 205/653 |
| 4,929,324 | A * | 5/1990 | Watanabe et al. | 204/206 |
| 6,991,717 | B2 * | 1/2006 | King et al. | 205/118 |
| 2004/0013812 | A1 * | 1/2004 | Kollmann et al. | 427/437 |
| 2004/0232005 | A1 * | 11/2004 | Hubel | 205/646 |
| 2005/0061661 | A1 | 3/2005 | Muller-Hipper et al. | |

FOREIGN PATENT DOCUMENTS

| | | |
|---|---|---|
| DE | 102 34 705 | 5/2003 |
| EP | 0 167 868 | 1/1986 |
| FR | 2 554 833 | 5/1985 |
| WO | WO 90/04049 | 4/1990 |

* cited by examiner

*Primary Examiner*—Bruce F Bell
(74) *Attorney, Agent, or Firm*—Berenato & White, LLC

(57) ABSTRACT

The invention relates to an apparatus for galvanically depositing an electrically conductive layer onto a carrier on which, at least in some regions, a starter layer suitable for electroplating is disposed. The apparatus has an electroplating bath in which an electrolyte for depositing conductive material is provided, at least two contact rollers which are disposed outside of the electroplating bath and which can be connected as cathode and/or anodes, and at least one deflection roller which is connected between the contact rollers, the position of the deflection roller being changeable between two contact rollers such that by changing the position of the deflection roller a distance to be covered by the carrier and which is formed between two contact points of two adjacent contact rollers corresponds to the extension of the starter layer to be coated.

24 Claims, 3 Drawing Sheets

CONDUCTIVE COATING OF SURFACES

CROSS-REFERENCE TO RELATED APPLICATIONS AND CLAIM TO PRIORITY

This application is related to application number 06 115 181.7, filed Jun. 8, 2006 with the European Patent Office and U.S. provisional patent application No. 60/814,700, filed Jun. 19, 2006, the disclosures of which are incorporated herein by reference and to which priority is claimed.

FIELD OF THE INVENTION

The present invention relates to an apparatus for galvanically depositing an electrically conductive layer onto a carrier on which, at least partially a starter layer is disposed, which is suitable for electroplating comprising an electroplating bath in which an electrolyte for depositing conductive material is provided, with at least two contact rollers which are disposed outside of the electroplating bath and which can be connected as cathodes and/or anodes, and with at least one deflection roller which is positioned between the contact rollers.

Apparatuses for galvanically depositing an electrically conductive layer onto a carrier are generally known. This type of electroplating apparatus or rather electroplating systems are often used to produce conductive structures or all-over conductive layers. For example, aerial coils, printed circuit boards, chip card modules or heating films for use in automotive engineering for example for heating external mirrors, rear windows or ribbon cables and similar are produced using this type of devices.

For this, in one exemplary embodiment a metal cylinder continuously connected as a cathode is at least partially immersed in an electrolyte bath and caused to rotate. An anode arrangement is located in the electrolyte bath. A metal layer is deposited on the slowly rotating cathode, and the layer is laminated onto a film outside of the electrolyte in that the metal film is peeled away from the cathode. After the metal layer has been laminated on, a resistant paint is applied which is then photolithographically exposed. With a subsequent etching step, those regions of the all-surface metal layer which are no longer required for a conductive structure are etched away. After removing the etching paint remaining on the structured metal layer, the desired conductive structure is complete.

The disadvantage of this method is on the one hand that only low throughput rates are achievable and high material costs and disposal costs arise due to the use of contaminative and expensive chemicals, as well as unused raw materials due to the subtractive method. On the other hand, the thickness of the metal layer is limited to a minimum thickness of 17 μm due to the possibility of crack formation which may occur otherwise by the further processing of the layer. Since, however, in the high frequency range a layer thickness of approximately 2 μm for example is desirable, the method described above can not be used for this type of application.

A further disadvantage is that anodic or mechanical cleansing of the cylindrical cathode must take place at regular intervals, and this further reduces the production and throughput times. Moreover, a metal layer can only be deposited onto the carrier substrate on one side.

A further method is described in laid open document DE 102 347 05 with which the item to be electroplated within the active electroplating bath is indirect contact with a circumferential collector roller connected alternately cathodically/anodically for continuous cleansing. However, the collector roller required for this is very expensive to produce and requires a lot of space because individual conductive regions must be separated from one another by insulating regions.

The size and the costs of the contact rollers only allow a small number of apparatuses connected one behind the other, and so limits the possible production speed.

Full cleansing in the polarity reverse phase of the segments is not possible. Therefore one must cleanse over and over again, discontinuously, using a cleansing fleece, and this interrupts production and can lead to longer cycle times and to contamination of the electrolyte.

A patent application not yet publicised and executed on behalf of the Applicant has as its object a contact unit which can be connected as the cathode and/or the anode, and is surrounded by an insulating housing. An opening is formed in the insulating housing in order to create a contact between the contact unit and the carrier to be coated. The contacting of the carrier material takes place here within an electroplating bath in the region of the opening. The remaining part of the contact unit is largely screened from the electrolyte in the electroplating bath by means of the insulating housing so that any depositing of the anode material is largely prevented in this region. Because in this arrangement the contact rollers are continuously in contact with the electrolyte, electrolyte deposits on the contact rollers do also result despite the small gap dimensions in the region of the opening in the housing. This can have a negative effect upon even coating of the carrier to be coated, for example by forming grooves in the conductor paths or by uneven depositing of the metal ions. Due to this problem, a stable process management can not be guaranteed, in particular over a longer period of time.

Therefore the Applicant changed the arrangement or rather the process management to the effect that the housing of the contact rollers were subjected to compressed air so as to only allow a minimal amount of electrolyte to pass into the housing or to blow out electrolyte.

Furthermore, the opening in the housing was reduced, and this meant that the housing was from now on more sensitive to wear and tear caused by contamination and also that, with the polyethylene rollers used, a reliable contact with the carrier material could no longer be guaranteed.

The polyethylene counterpressure rollers provided in the original design were changed to foam rubber rollers which, by their deformability, further sealed the open contact roller gap from electrolyte. Nevertheless after a certain amount of time small, hard impurities (copper spangles) led to grooves in the conductor paths when the required material tension was applied.

Therefore the contact rollers were arranged such that the path followed a particular curvature in order to be able to guarantee reliable contact, even with low tension.

The pole reversal of a contact roller implemented during the current process which was then swung away from the path increased the time taken to complete cleansing of the installation.

With these overall structural improvements the process could be maintained for a longer period of time, but afterwards all of the contact rollers had to undergo pole reversal and be mechanically cleansed by a strip-shaped cleansing fleece over a longer period of time.

In this way stable process management was achieved, but there was still the risk of grooves appearing on the strip conductors due to solid impurities (copper particles) constantly forming in the contact zones or of copper deposited on the contact rollers rubbing on the housings and uncontrolled zone-specific coppering thus occurring. The process then had to be subjected to unplanned interruptions.

SUMMARY OF THE INVENTION

Therefore, the object which forms the basis of the invention is to provide an apparatus for galvanically depositing an electrically conductive layer onto a carrier which enables reliable, fast, simple and cost-effective production of an electrically conductive layer onto a carrier with the most smooth surface possible.

In the apparatus according to the invention for galvanically depositing an electrically conductive layer, the position of the deflection roller located within the latter between two contact rollers symmetrically disposed outside of the electroplating bath is changeable such that by changing the position of the deflection roller a distance to be covered by the carrier material and which is formed between two contact points of two adjacent contact rollers corresponds to the extension of the starter layer to be coated.

By varying the position of the deflection roller it is possible for the regions of the carrier to be coated between the contact rollers to be subjected to electrical current almost constantly and at the same time the contact units supplying electrical current can be disposed outside of the electroplating bath and so there is no or only a small amount of contact with the electrolyte. The deflection rollers guide the length of material in accordance with its geometric form into the electrolyte bath. The starter layer to be coated is subjected here on the contact rollers to a voltage of between 0.5 and 5 V depending on the desired and achievable coating thickness.

A particularly stable and well-controllable process is created when the change in position of the deflection rollers in the apparatus takes place electrically and/or mechanically by means of an actuator. Therefore the position of the deflection rollers can also be adapted during the current process to any different extensions in the longitudinal or conveying direction of the regions on the carrier to be coated.

The electrolyte can be supplied by means of anode baskets filled with metal elements which are disposed in the electroplating bath, in particular such as to be height-adjustable, so as to be variable in accordance with the geometric form of the carrier and so with the change in position of the deflection rollers.

The continued movement of the carrier through the electroplating bath can be implemented by means of the contact rollers themselves which can respectively be driven, for example, by a speed-regulated drive unit, in particular by means of toothed wheels and/or a toothed belt. Other drive systems known in the prior art are also conceivable. The tension setting of the lengths of material can be guaranteed by a speed-regulated drive unit in the apparatus, a superposed desired value sequence control being provided between individual apparatuses in order to be able to change the strip speed for the whole installation according to the tension set between the coating modules.

It is advantageous if the motor gear units driving the contact rollers are disposed on the individual apparatuses such that if an apparatus is being dismantled, for example for maintenance purposes, they remain connected to the latter or are so easy to separate that no additional assembly or disassembly steps are required.

In one exemplary embodiment of the present invention, the contact rollers can be formed by a roller polished with a positive curve which holds the carrier in the central position. In order to guarantee that the carrier is guided centrally through the apparatus, a path control system can be provided in addition or instead.

In order to be able to guarantee gentle conveyance of material which is, for example, sensitive to scratching and/or tension, in one exemplary embodiment of the present invention the deflection rollers are in the form of an Airturn, i.e. a fixed pipe provided with blow-out holes and which can be subjected to compressed air, contact-free diversion of the carrier around the pipe being enabled by the air passing out at the blow-out holes.

In one exemplary embodiment an overflow or a weir, in particular in the form of elongated holes, is formed in the electroplating bath in order to keep the level of the electrolyte bath constant when the electrolyte is being pumped around and flowing in during the electroplating process.

In order to be able to protect the contact rollers from any electrolyte which may have been dragged along by the carrier, in one exemplary embodiment wipers are provided on one side of the contact rollers at which the carrier passing out of the electroplating bath first comes to rest. In addition, the contact rollers can be protected from below from subjection to electrolyte fluid by synthetic supports. If the contact rollers lie totally above the electrolyte level, the strip is guided by at least one deflection roller around the contact roller to the lowest apex (6 o'clock position) and is only then immersed in the electrolyte.

In the event that impurities are nevertheless deposited on the contact roller, in a further exemplary embodiment on one side of the contact rollers, in particular at which the carrier passing into the electroplating bath last comes to rest, a scraper is provided for scraping away the electrolyte material deposited on the contact roller. When using a metal scraper, the debris from the scraper can then be conveyed into the electrolyte or the anode baskets and disintegrates again here.

In order to convey any electrolyte dragged along back into the electroplating cycle, a drain channel can be formed beneath the contact roller which guides the electrolyte into a collecting tray or into the electroplating bath.

The voltage can be supplied to the contact rollers on both sides with collector rings. In order to distribute the voltage homogeneously and to prevent a decrease in voltage due to the contact roller width which could lead to different coppering on the carrier, especially with greater machine width, a voltage distributor can be provided on the contact rollers. This can be fitted, for example, into the synthetic support disposed beneath the contact roller.

Precise levelling of the apparatus is important because the level of the electrolyte has to lie only a few millimeters below the edge of the synthetic support. Only with the smallest possible distance of the electrolyte level from the contact roller a maximum time for supplying voltage for coppering on the carrier layer can be maintained, and very short objects can be coated in the moving direction.

Since the deflection roller is partially fully immersed in the electrolyte, it is advantageous to mount the deflection roller in bearings suitable for electroplating, such as for example glass ball bearings. The contact rollers however are mounted outside of the electrolyte and therefore they may be provided with conventional bearings.

In order to prevent this mounting from coming into contact with electrolyte, for example if leakages occur on the shaft feedthroughs, in one exemplary embodiment spacer units are provided in the bearing housings in relation to the side walls of the electroplating bath into which the electrolyte carried along can drip off before it can pass undesirably into the region of the bearings of the contact rollers. The advantage of this on the one hand is that very cost-effective standard bearings can be used. On the other hand, very easy dismantling is possible due to better accessibility.

In a further exemplary embodiment of the present invention at least one closure flap is provided in the wall of the electroplating bath, and this enables particularly simple insertion and re-fitting of the anode baskets beneath the contact rollers.

Furthermore, additional ion enrichment of the electrolyte can be provided outside of the electroplating bath so that the anode baskets can be made smaller by means of which the dimensions of the apparatus and so of the whole installation can be considerably reduced. The anode baskets can be filled for example with copper balls. However, any other material suitable for electroplating can be used in the anode baskets.

An electroplating system according to the invention comprises at least one apparatus for galvanically depositing an electrically conductive layer as well as a conveying apparatus, for example in the form of material strip winding by means of which the carrier is conveyed, and at least one receiving apparatus, for example in the form of a material strip rewind which subsequently receives the carrier once again.

In one exemplary embodiment a preliminary electrolyte bath is connected upstream of the electroplating system of the apparatus. This serves for initial metalizing of the conductive layer printed onto the carriers without any electrical current supply being provided in the electrolyte bath. The starter layer printed for example with an iron carbonyl color or some other suitable material is metalized by approx. 1-2 μm when it is conveyed through the defined electrolyte bath. In this way the sensitive print color consisting of poorly adherent spherical pigments is covered with a thin metal layer so that mechanical abrasion of the particles and pigments in the initial sequence processes is avoided or at least reduced.

In order to be able to control the progress of the metal depositing, at least one measuring unit, for example for measuring the thickness and/or the resistance of the structures being produced, can be disposed between two respective apparatuses in the system. Of course it is also possible to provide other measuring devices advantageous for process control and monitoring for example in order to establish the surface finish or similar in this region.

In one exemplary embodiment of the electroplating system the apparatuses are connected one behind the other, it being possible to easily remove each respective apparatus from the installation for maintenance, repair or refitting work without the carrier having to be removed or the coating process having to be stopped for this. Only the deflection rollers need be moved upwards in the region of the apparatuses to be removed so that the carrier in this area only rests on the guide rollers disposed to the side of the deflection rollers and the actual coating process can be continuously sustained. For this, the apparatuses can for example be disposed in frame structures such that they can be drawn out to the side for maintenance work. In order to be able to continuously operate the installation despite possible maintenance work, in one exemplary embodiment according to the invention additional apparatuses can be provided.

If an apparatus is to be used once again after the maintenance, it is simply pushed back into its former position in the electroplating system, and the deflection rollers are moved back into the position adapted to the strip length. The apparatuses can thus be used without the strip having to be re-introduced or the coating process having to be interrupted.

In a further exemplary embodiment a cleansing and/or inertization module is furthermore provided in the electroplating system, and this contains a bath with distilled water for cleansing and/or an inertization bath containing citric acid.

The number of apparatuses in an electroplating system depends upon the desired strip speed and the required coppering grade. Coppering grades of between 1 μm and 100 μm, preferably between 5 μm and 40 μm, and even more preferably between 3 μm and 20 μm may therefore be desired. In order to achieve a coppering grade, dependently upon the conveying speed of the carrier, 30 to 40 apparatuses for example may be required. These can either be disposed next to one another or also over one another, for example in four columns each with ten modules. Due to the flexible possibility for arranging the apparatuses, the machine can be adapted relatively flexibly to the space available for production despite a large number of apparatuses.

The contact rollers should preferably always be arranged symmetrically. In this way, even very short structures can be evenly coated. If the distance between the electrolyte level and the contact point of the carrier with the contact roller is too big, the level of the electroplating bath can be raised, for example by raising the overflow. This leads to a reduced production speed, however, because greater wetting of the contact rollers with electrolyte may result, by means of which the risk arises of the contact rollers being applied more quickly to the material located in the electrolyte.

With longer extensions of the starter layer it may be advantageous for example to provide two or even more deflection rollers respectively between the contact rollers in order to guarantee the most homogenous possible conveyance of the carrier.

With the electroplating system according to the invention it is possible to metallise printed material lengths both on one side and on both sides, for example by specific punching through the material lengths by means of which the side of the material not in contact with the contact roller can be reached by the corresponding through-contact. In this very case it is advantageous to guide the length of material through a preliminary electrolyte bath before the actual electroplating process in order to achieve initial metallising which makes it possible for the structures on the side of the carrier facing away from the contact rollers which are not in direct contact with the contact rollers to also be correspondingly subjected to voltage. With the through-contacted structure, the length of material is conveyed through the apparatus with the more strongly printed side facing towards the contact rollers.

The carrier used, in particular in the shape of a strip, must be waterproof and have sufficient tensile strength. The material of the carrier is preferably made of a synthetic such as, for example PP, PET, PU, acrylate or similar. The use of fleeces or waterproof paper is also possible by means of special material management.

BRIEF DESCRIPTION OF THE DRAWINGS

With regard to further advantageous embodiments and further developments of the invention, reference is made to the sub-claims and to the following description of an exemplary embodiment on the basis of the attached drawings.

The drawings show as follows.

DETAILED DESCRIPTION OF THE PREFERRED EMBODIMENT(S)

Figure 1:
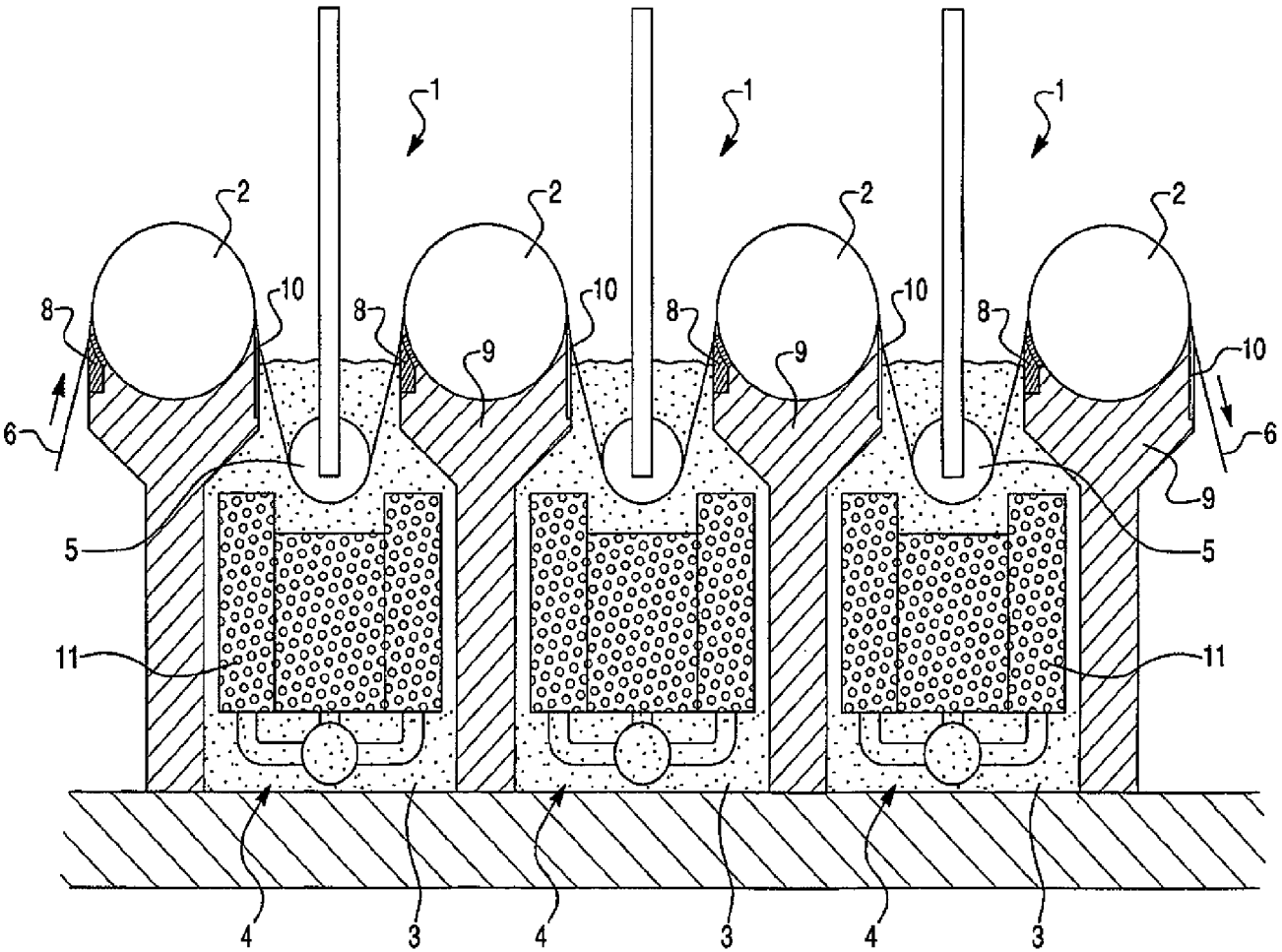
FIG. 1 is a schematic illustration of an apparatus according to the invention.

FIG. 1 shows three apparatuses 1 according to the invention for depositing a conductive layer with four contact rollers 2 which are disposed symmetrically to the side outside of three electroplating baths 4 respectively filled with an electrolyte 3.

Respectively disposed between two contact rollers 2 is a deflection roller 5 which is height-adjustable by means of a servo-motor (not shown). A carrier 6 to be placed in contact and to be coated is in the form of an infinite film and, as indicated by arrows in FIG. 1, is guided over the contact rollers 2 and deflection rollers 5 through the individual apparatuses 1. By means of the set position of the deflection rollers 5, the carrier 6 passes through the electrolyte 3 in the electroplating baths 4. The carrier 6 is printed, in regions with a so-called starter layer 7, made for example of non-conductive iron carbonyl particles (see also FIG. 3), which e.g. forms an antenna structure. Only when a current from the contact roller 2 is applied to the starter layer 7 the particles of the starter layer 7 on the carrier 6 become conductive.

In order to be able to protect the contact rollers 2 from any electrolyte 3 which may have been dragged along by the carrier 6, wipers 8 are provided at one side of the contact rollers 2 at which the carrier 6 passing out of the electroplating bath 4 first comes to rest. In addition, the contact rollers 2 can be protected from below against subjection to electrolyte 3 by synthetic supports 9.

In the event that anode material or impurities are nevertheless undesirably deposited on the contact rollers 2, on one side of the contact rollers 2 at which the carrier 6 passing into the electroplating bath 4 at last comes to rest, a scraper 10 is provided for scraping away the anode material deposited on the contact rollers 2. The debris from the scraper 10 is conveyed into anode baskets 11 and then disintegrated again.

In order to convey any electrolyte 3 which may have been dragged along back into the electroplating cycle, a drain channel (not shown) is formed below the contact rollers 2, and this guides the electrolyte 3 into a collecting tray or into the electroplating bath 4.

Figure 2:
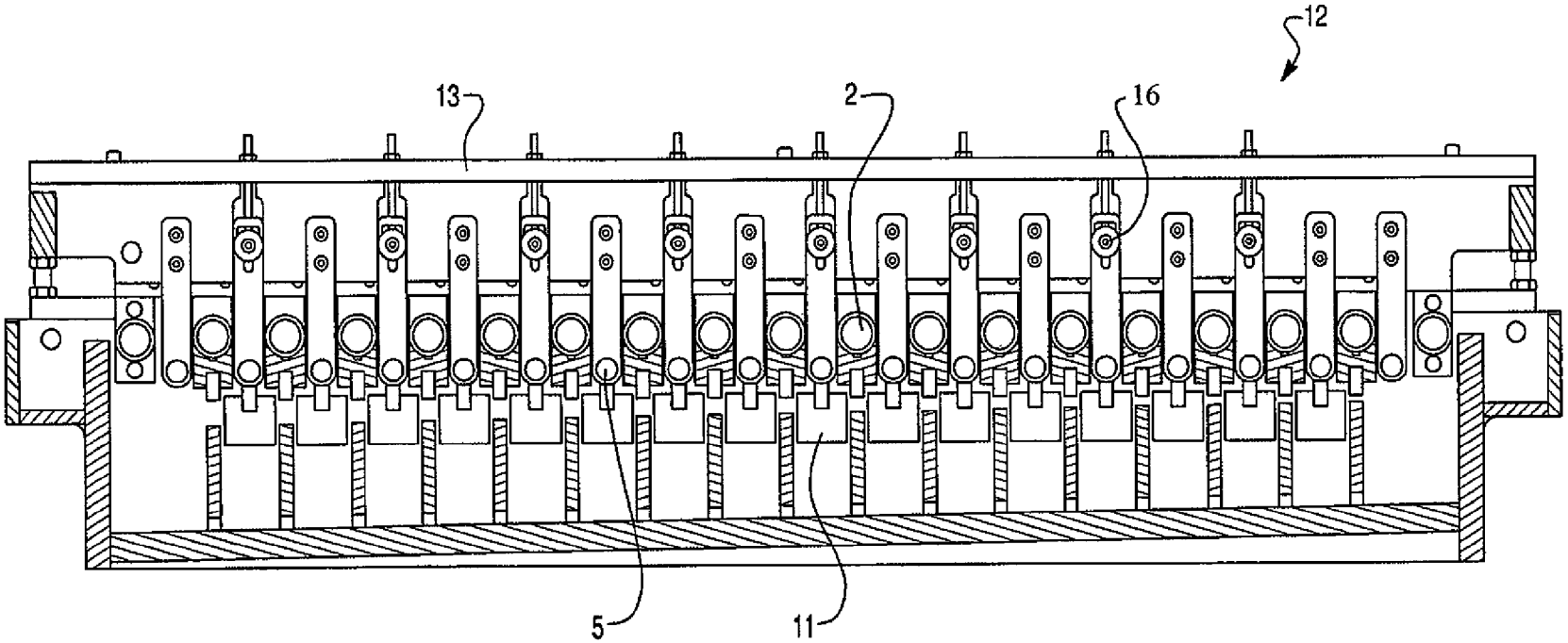
FIG. 2 is a cross-section through a module of an electroplating system according to the invention.

FIG. 2 shows a cross-section through an electroplating module 12 which comprises sixteen apparatuses 1. In this module 12 the deflection rollers 5 are attached to a frame structure 13. By moving the frame structure 13 it is possible to adjust the height of the deflection rollers 5 synchronously and so to establish the path along which the carrier 6 is conveyed through the electroplating baths 4, and to optimally adapt it to the extensions of the starter layer 7 on the carrier 6. By means of knurled-head screws 16 it is possible to finely adjust the positions of the deflection rollers 5 relative to one another. Guide rollers (not shown) enable the most even possible movement in the vertical direction and prevent the deflection rollers 5 and the frame structure 13 from tilting.

One galvanization system according to the invention is made up of between 30 and 40 of these electroplating modules 12 which are disposed both one behind the other and one above the other, and so they can be adapted to the space available.

In order to coat the starter layer 7 on the carrier 6 with a conductive material, the carrier 6 is first of all conveyed from a material winding unit over a punching unit (not shown) for punching through the carrier 6 at specific points in order to coat the carrier 6 on both sides into a preliminary electrolyte bath. In the preliminary electrolyte bath the starter layer 7 printed onto the carrier 6 and which is formed, for example, by a printed on iron carbonyl color, is metalized by approx. 1 to 2 μm in the defined electrolyte bath. By means of this metallization the sensitive, often poorly adherent, starter layer 7 made of spherical iron carbonyl pigments is protected against mechanical abrasion of the iron particles in the first sequence processes. The carrier 6 is then passed to a series of modules 12 connected one behind the other according to FIG. 2.

If a power supply (not shown) is applied cathodically to the contact rollers 2, the surface of the carrier 6 passing through the modules 12 is charged such that anode material located in the electrolyte 3 is deposited on the starter layer 7 of the carrier 6 so that a conductive, highly homogeneous copper layer is deposited on the starter layer 7 of the carrier 6. At the same time further metal ions pass into the electrolyte 3 from the anode baskets 11. By means of an additional supply module (not shown) the concentration of metal ions located in the electrolyte 3 can be controlled.

In the case where the carrier 6 is printed on two sides, it is guided through the modules 12 with the more strongly printed side on the contact rollers 2. The deflection rollers 5 convey the carrier 6 through the electrolyte in the electroplating bath 4. The starter layer 7, which is now conductive, receives the voltage at the contact rollers 2. The direct voltage is applied negatively at approx. 0.5 to 5 V depending on the desired and possible metallization thickness. Currents of up to over 50 A per apparatus unit 1 flow here. The carrier 6 is then immersed into the electrolyte 3 enriched, for example, with copper ions, and further ions correspondingly to be found in the electrolyte solution are deposited on the layer which is already coppered. By means of the punch-throughs at specific points of the carrier 6, the carrier side facing away from the contact roller 2 of a carrier 6 printed on both sides can also be metalized.

Because the contact rollers 2 are always arranged symmetrically, very short printed objects/starter layers 7 can also be evenly coated. The short length of the strip of material between the contact rollers 2 makes it possible with longer extensions of the starter layers 7 in the longitudinal and conveying direction to constantly apply an electrical direct current. With longer extensions of the starter layer 7 it can be advantageous, for example, to provide two deflection rollers 5 respectively between the contact rollers 2 in order to guarantee the most homogeneous possible conveyance of the carrier 6. With shorter objects the flow of current can, if appropriate, be interrupted briefly. By adjusting the position of the deflection rollers 5 between two contact rollers 2, it is possible to adapt the strip length of the starter layer 7 on the carrier 6 in the electrolyte 3. By changing the position of the deflection rollers 5 between two contact rollers 2, a section to be covered by the carrier 6 in the electroplating bath 4 which is formed between two contact points of two adjacent contact rollers 2 can be adapted to the extension of the starter layer 7 to be coated. In this application extension means the dimensions of the starter layer 7, in particular in the longitudinal direction or the conveying direction of the length of material 6 to be conveyed.

While the carrier 6 is being conveyed, the carrier 6 is guided with a lot of support. Because of this, very thin material or material which is sensitive to tension can be processed. In one exemplary embodiment (not shown) a cleansing and inertization module is interconnected in the system. This consists of a bath with distilled water for purification and an inertization bath containing, for example, citric acid.

Finally, the carrier 6 already coated with the required layer thickness is conveyed over a drying unit (not shown) of a material length winding unit with the finished structures.

Figure 3:
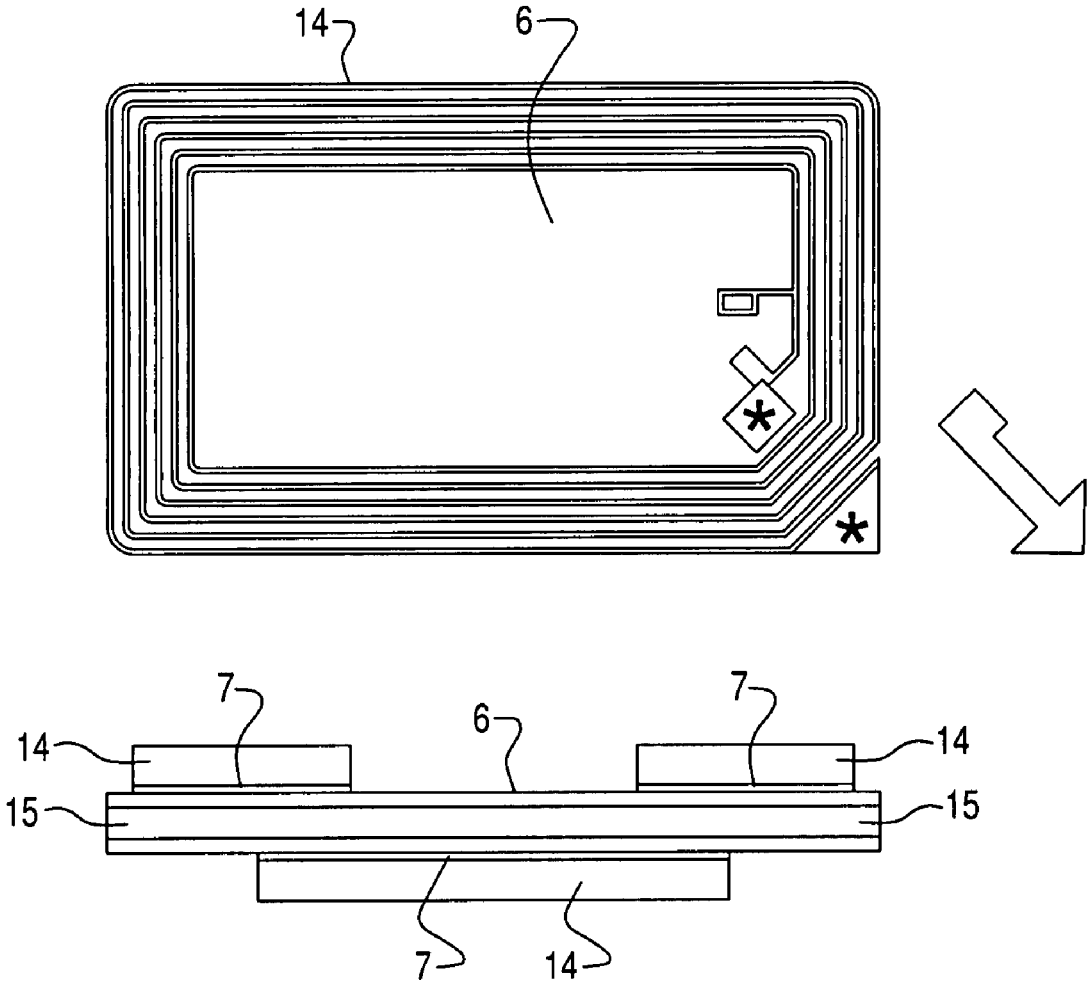
FIG. 3 is a carrier according to the invention with a printed starter layer in the form of an antenna structure.

FIG. 3 shows a carrier 6 according to the invention which is provided with a starter layer 7 in the form of an antenna. The carrier 6 is provided with slots 15 for generating copper layers 14 both on the top side and on the bottom side which form a so-called through-contact when the carrier is printed with a starter layer 7. Above the starter layer 7 a galvanically deposited copper layer 14 is respectively formed.

We claim:

1. An apparatus for galvanically depositing an electrically conductive layer onto a carrier on at least a part of which a starter layer is disposed suitable for electroplating, comprising:

an electroplating bath provided with an electrolyte for depositing conductive material;

at least two contact rollers disposed outside of the electroplating bath, the contact rollers being operable as cathodes and/or anodes; and at least one deflection roller positioned between the contact rollers;

wherein the position of the deflection roller between the at least two contact rollers is changeable to extend a distance to be traveled by the carrier to be conveyed through the electroplating bath for coating the starter layer on the carrier.

2. The apparatus according to claim 1, further comprising an actuator for electrically and/or mechanically changing the position of the deflection roller.

3. The apparatus according to claim 1, further comprising anode baskets filled with metal elements disposed in the electroplating bath.

4. The apparatus according to claim 1, further comprising a speed-regulated drive unit for driving the contact rollers to convey the carrier through the electroplating bath.

5. The apparatus according to claim 1, wherein the contact rollers are polished with a positive curve so as to hold the carrier in a central position when being conveyed.

6. The apparatus according to claim 1, wherein the deflection rollers comprise fixed pipes provided with blow-out holes.

7. The apparatus according to claim 1, further comprising an overflow formed in the electroplating bath.

8. The apparatus according to claim 1, further comprising a wiper provided on a side of one of the contact rollers that receives the carrier as the carrier passes out of the electroplating bath.

9. The apparatus according to claim 1, further comprising a scraper provided on a side of one of the contact rollers that passes the carrier into the electroplating bath for scraping away the electrolyte deposited on the contact roller.

10. The apparatus according to claim 1, further comprising collector rings for supplying voltage to both sides of the contact rollers.

11. The apparatus according to claim 10, further comprising a voltage distributor or segmented contact rollers with a corresponding power supply for homogeneously distributing the voltage.

12. The apparatus according to claim 1, further comprising glass ball bearings on which the deflection roller is mounted.

13. The apparatus according to claim 1, further comprising spacer units provided between housings of bearings of the contact rollers and side walls of the electroplating bath.

14. The apparatus according to claim 3, further comprising a flap formed in the electroplating bath for permitting the anode baskets to be changed.

15. The apparatus according to claim 1, further comprising external electrolyte enrichment provided outside of the electroplating bath.

16. An electroplating system, comprising:

at least one apparatus according to claim 1;

at least one conveyance apparatus which conveys the carrier; and at least one receiving apparatus which receives the carrier.

17. The electroplating system according to claim 16, further comprising a preliminary electrolyte bath connected upstream of the at least one apparatus.

18. The electroplating system according to claim 16, further comprising at least one measuring unit disposed between at least two apparatuses for measuring the thickness and/or the resistance of the layer thicknesses of the starter layer.

19. The electroplating system according to claim 16, wherein the apparatuses can be individually removed from the electroplating system for maintenance work.

20. The electroplating system according to claim 16, further comprising a cleansing and/or an inertization module.

21. The apparatus according to claim 1, wherein the at least one deflection roller comprises a first deflection roller, and wherein the apparatus further comprises:

a second deflection roller; and a frame structure attached to at least the first and second deflection rollers and movable to adjust the position of at least the first and second deflection rollers in synchronicity with one another to change the distance to be traveled by the carrier conveyed through the electroplating bath for coating the starter layer on the carrier.

22. The apparatus according to claim 21, wherein the first and second deflection rollers are immersed in the electroplating bath.

23. The apparatus according to claim 1, wherein the at least one deflection roller comprises a first deflection roller, and wherein the apparatus further comprises:

a second deflection roller; and a frame structure attached to at least the first and second deflection rollers and adjustable to cause identical changes to the heights of at least the first and second deflection rollers in the electroplating bath in synchronicity with one another to change the distance to be traveled by the carrier conveyed through the electroplating bath for coating the starter layer on the carrier.

24. The apparatus according to claim 23, wherein the first and second deflection rollers are immersed in the electroplating bath.

* * * * *